US011073163B2

(12) United States Patent
Saito

(10) Patent No.: US 11,073,163 B2
(45) Date of Patent: Jul. 27, 2021

(54) CENTRIFUGAL COMPRESSOR

(71) Applicant: MITSUBISHI HEAVY INDUSTRIES, LTD., Tokyo (JP)

(72) Inventor: Ryosuke Saito, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 138 days.

(21) Appl. No.: 16/491,359

(22) PCT Filed: Mar. 27, 2018

(86) PCT No.: PCT/JP2018/012477
§ 371 (c)(1),
(2) Date: Sep. 5, 2019

(87) PCT Pub. No.: WO2018/181343
PCT Pub. Date: Oct. 4, 2018

(65) Prior Publication Data

US 2020/0056624 A1 Feb. 20, 2020

(30) Foreign Application Priority Data

Mar. 31, 2017 (JP) ..... JP2017-071308

(51) Int. Cl.
*F04D 29/44* (2006.01)
*F04D 17/12* (2006.01)

(52) U.S. Cl.
CPC ..... *F04D 29/44* (2013.01); *F04D 17/12* (2013.01); *F04D 17/122* (2013.01); *F04D 29/441* (2013.01); *F04D 29/444* (2013.01)

(58) Field of Classification Search
CPC ..... F04D 29/44; F04D 29/441; F04D 29/444; F04D 17/12; F04D 17/122
See application file for complete search history.

(56) References Cited

U.S. PATENT DOCUMENTS

2010/0272564 A1* 10/2010 Richter ..... F04D 17/122 415/208.1
2015/0308453 A1* 10/2015 Nakaniwa ..... F04D 29/444 415/59.1

(Continued)

FOREIGN PATENT DOCUMENTS

JP 2013-194558 9/2013

OTHER PUBLICATIONS

International Search Report dated Jun. 26, 2018 in International (PCT) Application No. PCT/JP2018/012477.

(Continued)

*Primary Examiner* — David Hamaoui
*Assistant Examiner* — Andrew J Marien
(74) *Attorney, Agent, or Firm* — Wenderoth, Lind & Ponack, L.L.P.

(57) ABSTRACT

A centrifugal compressor includes impellers arranged in a plurality of stages in a direction of an axis line so that a working fluid flowing from one side inlet in the direction of the axis line is pumped outward in a radial direction, and a casing that surrounds the impellers, and that has a return channel through which the working fluid discharged from the impeller on a front stage side between the impellers adjacent to each other is guided inward in the radial direction so as to be introduced to the impeller on a rear stage side, and a plurality of return vanes disposed at an interval in a circumferential direction inside the return channel. The return vane is configured so that the thickness of a hub side in a leading edge side region is thicker than the thickness of a shroud side.

7 Claims, 5 Drawing Sheets

(56) References Cited

U.S. PATENT DOCUMENTS

| | | | | |
|---|---|---|---|---|
| 2019/0368497 | A1* | 12/2019 | Hartmann | F04D 17/122 |
| 2020/0025205 | A1* | 1/2020 | Petry | F04D 17/122 |

OTHER PUBLICATIONS

Written Opinion of the International Searching Authority dated Jun. 26, 2018 in International (PCT) Application No. PCT/JP2018/012477, with English Translation.

* cited by examiner

CENTRIFUGAL COMPRESSOR

TECHNICAL FIELD

The present invention relates to a centrifugal compressor.

Priority is claimed on Japanese Patent Application No. 2017-071308, filed on Mar. 31, 2017, the content of which is incorporated herein by reference.

BACKGROUND ART

As a centrifugal compressor used for an industrial compressor, a turbo refrigerator, a small gas turbine, and a pump, a multistage centrifugal compressor is known which includes an impeller in which a plurality of blades are attached to a disk fixed to a rotating shaft. The multistage centrifugal compressor provides a working fluid G with pressure energy and velocity energy by rotating the impeller.

A pair of the impellers adjacent to each other in an axial direction of a rotating shaft is connected to a return channel. The return channel is provided with a return vane for removing a turning component from the working fluid.

CITATION LIST

Patent Literature

[Patent Document 1] Japanese Unexamined Patent Application, First Publication No. 2013-194558

DISCLOSURE OF INVENTION

Technical Problem

Incidentally, in the centrifugal compressor including the above-described return vane, the working fluid may be separated on a suction surface of the return vane in some cases. Particularly in a case where a diameter of the centrifugal compressor is reduced from a viewpoint of cost reduction, an outer diameter in an inlet of the return vane is reduced. Accordingly, a flow rate in the inlet increases. Therefore, on a leading edge side of the return vane, the working fluid is likely to be separated on a suction side or a hub side.

If such a separation region exists in a wide range of the return vane, efficiency as the centrifugal compressor is degraded.

The present invention is made in view of the above-described circumstances, and an object thereof is to provide a centrifugal compressor which can prevent degraded efficiency.

Solution to Problem

In order to solve the above-described problem, the present invention adopts the following means. According to a first aspect of the present invention, there is provided a centrifugal compressor including a rotating shaft rotated around an axis line, impellers arranged in a plurality of stages in the rotating shaft in an axial direction so that a working fluid flowing from one side inlet in the axial direction is pumped outward in a radial direction, a casing that surrounds the rotating shaft and the impellers, and that has a return channel through which the working fluid discharged from the impeller on a front stage side between the impellers adjacent to each other is guided inward in the radial direction so as to be introduced to the impeller on a rear stage side, and a plurality of return vanes disposed inside the return channel at an interval in a circumferential direction. The return vane is configured so that the thickness of a hub side on one side in the axial direction in a region including a leading edge is thicker than the thickness of a shroud side on the other side in the axial direction.

According to the centrifugal compressor configured in this way, the interval in the circumferential direction between the return vanes adjacent to each other in the circumferential direction is smaller on the hub side than that on the shroud side. Therefore, a pressure gradient between the return vanes is more remarkable on the hub side having a smaller interval than on the shroud side having a larger interval. As a result, out of secondary flows from a pressure surface of the return vane to a suction surface of the return vanes adjacent to each other, the secondary flow on the hub side is particularly larger than the secondary flow on the shroud side. In this manner, a large amount of a high energy fluid on the pressure surface of one return vane is supplied to the hub side of the suction surface of the other return vane adjacent to the one return vane.

Here, a separation region on the suction surface of the return vane has the following tendency. Due to influence that a flow path on an outlet side of the return vane is curved to the other side in the axial direction, the separation region moves close to the shroud side inside the return vane, as the separation region is directed toward an inner downstream side in the radial direction. The separation region hinders a mainstream flow, and degrades efficiency of the centrifugal compressor. Accordingly, it is preferable to minimize the area occupied by the separation region as much as possible on the suction surface of the return vane.

According to this aspect, as described above, the high energy fluid on the hub side on the pressure surface of one return vane is supplied to the hub side on the suction surface of the other return vane adjacent to the one return vane. Therefore, the high energy fluid pushes the separation region to the shroud side, on the suction surface of the return vane. Therefore, the separation region originally moved close to the shroud side can be further moved closer to the shroud side. As a result, it is possible to decrease the occupied area of the separation region S on the suction surface of the return vane. Therefore, the mainstream flow can be prevented from being hindered, and the centrifugal compressor can be prevented from having degraded efficiency. The high energy fluid supplied from the pressure surface of the return vane to the suction surface less interferes with the separated fluid on the suction surface. Accordingly, there is no great energy loss.

In the centrifugal compressor, it is preferable that the thickness of the return vane monotonically decreases from the hub side toward the shroud side, in the region including the leading edge.

In this manner, the pressure gradient between the return vanes adjacent to each other gradually increases toward the hub side. Therefore, the high energy fluid on the hub side on the pressure surface can be properly transported to the hub side on the suction surface.

In the centrifugal compressor, it is preferable that a region including the leading edge is 10% to 30% of a region from the leading edge toward a trailing edge in a radial dimension of the return vane.

A pressure difference between the pressure surface of the return vane and the suction surface is most remarkable on the leading edge side where a fluid flow is diverted. Moreover, the pressure difference between the pressure surface of the return vane and the suction surface is smaller on the trailing edge side. Therefore, a region where the thickness on the hub side of the return vane is thicker than the thickness on the shroud side is set only within the above-described range on the leading edge side. In this manner, an advantageous effect can be sufficiently achieved. In addition, in a case where a thickness gradient on the hub side and the shroud side of the return vane is formed by carrying out cutting work, the work may be carried out only within the above-described range. Accordingly, an increase in manufacturing cost can be prevented.

Advantageous Effects of Invention

According to the centrifugal compressor of the present invention, degraded efficiency can be prevented.

BEST MODE FOR CARRYING OUT THE INVENTION

Figure 1:
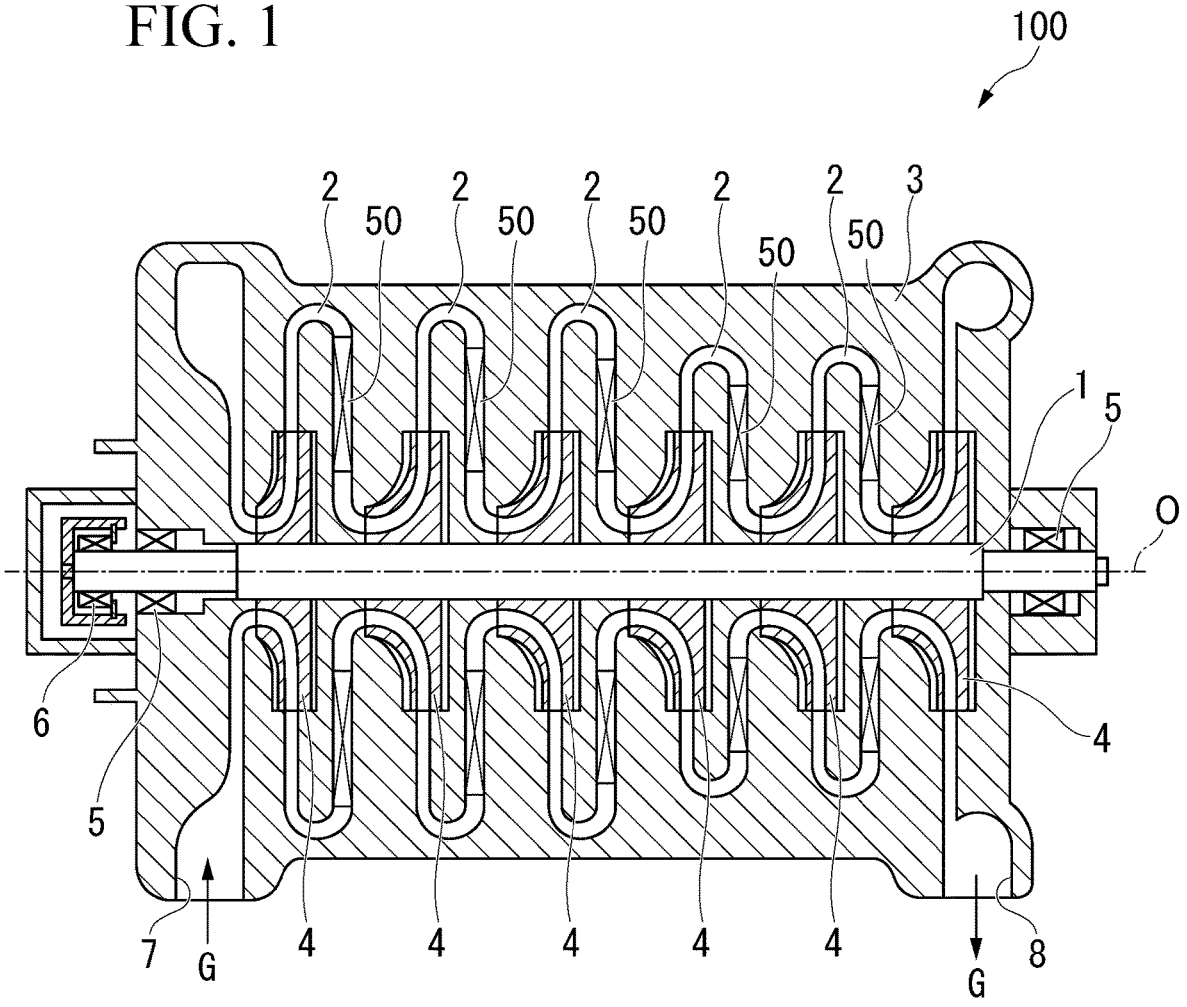
FIG. 1 is a longitudinal sectional view of a centrifugal compressor according to an embodiment.

Hereinafter, a centrifugal compressor according to a first embodiment of the present invention will be described with reference to the drawings. As shown in FIG. 1, a centrifugal compressor 100 includes a rotating shaft 1 rotated around an axis line O, a casing 3 forms a flow path 2 by covering the periphery of the rotating shaft 1, a plurality of impellers 4 disposed in the rotating shaft 1, and a return vane 50 disposed inside the casing 3.

The casing 3 has a cylindrical shape extending along the axis line O. The rotating shaft 1 extends so as to penetrate through an interior of the casing 3 along the axis line O. A journal bearing 5 and a thrust bearing 6 are respectively disposed in both end portions of the casing 3 in a direction of the axis line O. The rotating shaft 1 is supported by the journal bearing 5 and the thrust bearing 6 so as to be rotatable around the axis line O.

A suction port 7 for fetching air serving as a working fluid G from the outside is disposed on one side of the casing 3 in the direction of the axis line O. Furthermore, an exhaust port 8 for discharging the working fluid G compressed inside the casing 3 is disposed on the other side of the casing 3 in the direction of the axis line O.

An internal space which allows the suction port 7 and the exhaust port 8 to communicate with each other and whose diameter is repeatedly reduced and enlarged is formed inside the casing 3. The internal space accommodates a plurality of impellers 4, and forms a portion of the above-described flow path 2. In the following description, a side where the suction port 7 is located on the flow path 2 will be referred to as an upstream side, and a side where the exhaust port 8 is located on the flow path 2 will be referred to as a downstream side.

Figure 2:
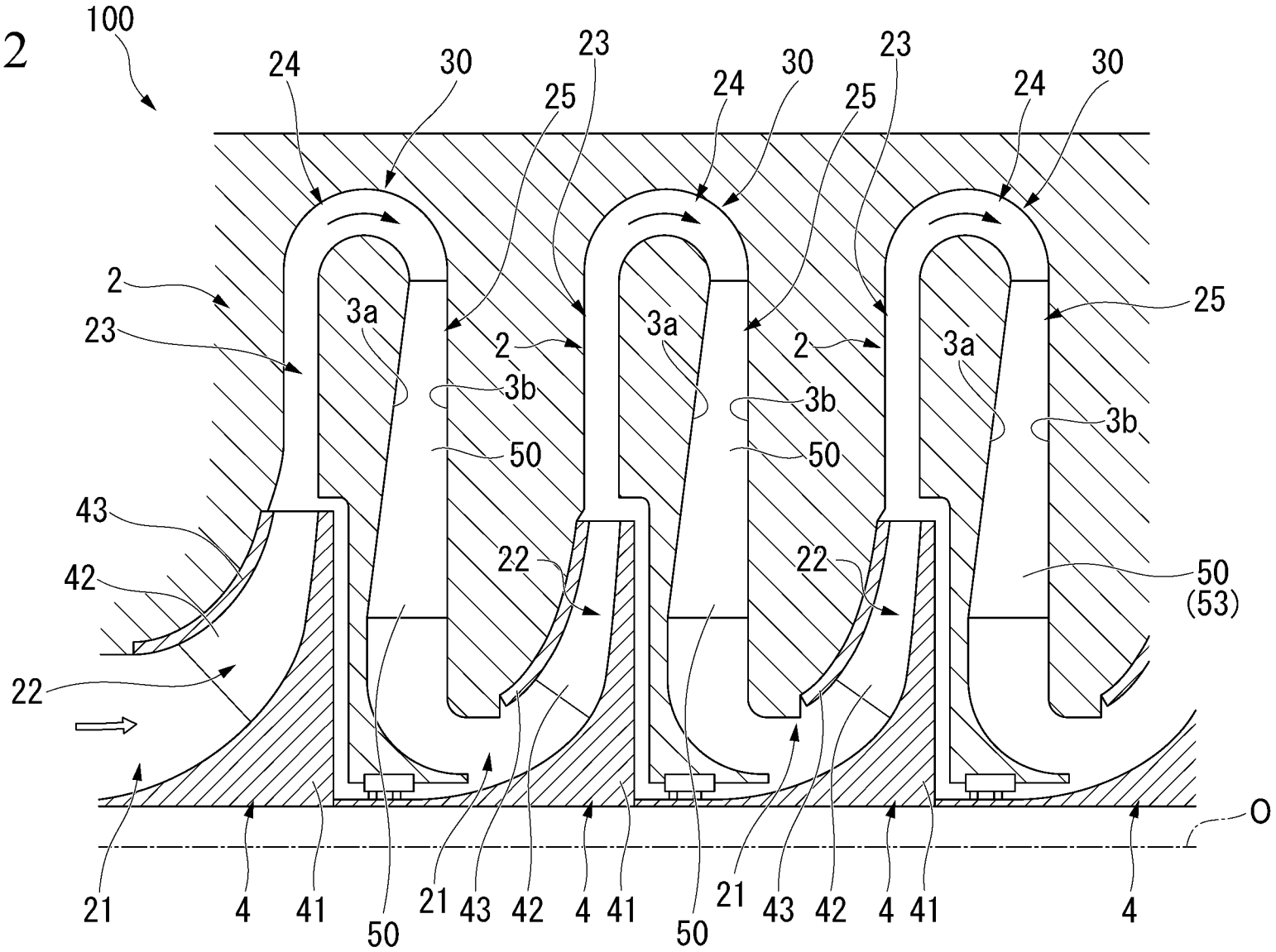
FIG. 2 is a longitudinal sectional view showing a partially enlarged portion of the centrifugal compressor according to the embodiment.

An outer peripheral surface of the rotating shaft 1 has the plurality of (six) impellers 4 at an interval in the direction of the axis line O. As shown in FIG. 2, the respective impellers 4 have a disk 41 having a substantially circular cross section when viewed in the direction of the axis line O, a plurality of blades 42 disposed on a surface on the upstream side of the disk 41, and a cover 43 which covers the plurality of blades 42 from the upstream side.

The disk 41 is formed so that a radial dimension is gradually broadened from one side to the other side in the direction of the axis line O when viewed in a direction intersecting the axis line O, thereby forming a substantially conical shape.

The plurality of blades 42 are radially arrayed outward in the radial direction around the axis line O, on a conical surface facing the upstream side out of both surfaces of the above-described disk 41 in the direction of the axis line O. More specifically, the blades are formed of thin plates erected toward the upstream side from the surface on the upstream side of the disk 41. The plurality of blades 42 are curved from one side to the other side in a circumferential direction when viewed in the direction of the axis line O.

The cover 43 is disposed in an end edge on the upstream side of the blades 42. In other words, the plurality of blades 42 are interposed between the cover 43 and the disk 41 in the direction of the axis line O. In this manner, a space is formed among the cover 43, the disk 41, and the pair of blades 42 adjacent to each other. The space forms a portion of the flow path 2 (compression flow path 22, to be described later).

The flow path 2 is a space which allows the impeller 4 configured as described above and the internal space of the casing 3 to communicate with each other. In the present embodiment, an example will be described where one flow path 2 is formed for each impeller 4 (for each compression stage). That is, in the centrifugal compressor 100, five flow paths 2 continuous from the upstream side to the downstream side are formed corresponding to five impellers 4 except for the impeller 4 in a rearmost stage.

The respective flow paths 2 have a suction flow path 21, a compression flow path 22, a diffuser flow path 23, and a return channel 30. FIG. 2 mainly shows the impellers 4 in first to third stages out of the flow paths 2 and the impellers 4.

In the impeller 4 in the first stage, the suction flow path 21 is directly connected to the above-described suction port 7. The suction flow path 21 fetches external air serving as the working fluid G into each flow path on the flow path 2. More specifically, the suction flow path 21 is gradually curved outward in the radial direction from the direction of the axis line O as the suction flow path 21 faces from the upstream side to the downstream side.

The suction flow path 21 in the impellers 4 in the second and subsequent stages communicates with a downstream end of a guide flow path 25 (to be described later) in the flow path 2 in a front stage (first stage). That is, a flowing direction of the working fluid G passing through the guide flow path 25 is changed so as to face the downstream side along the axis line O in the same manner as described above.

The compression flow path 22 is surrounded by a surface on the upstream side of the disk 41, a surface on the downstream side of the cover 43, and the pair of blades 42 adjacent to each other in the circumferential direction. More specifically, a cross-sectional area of the compression flow path 22 gradually decreases as the compression flow path 22 faces outward from the inside in the radial direction. In this manner, the working fluid G circulating in the compression flow path 22 in a rotated state of the impeller 4 is gradually compressed to be a high pressure fluid.

The diffuser flow path 23 extends outward from the inside in the radial direction of the axis line O. An inner end portion in the radial direction in the diffuser flow path 23 communicates with an outer end portion in the radial direction of the above-described compression flow path 22.

The return channel 30 causes the working fluid G facing outward in the radial direction to turn inward in the radial direction and to flow into the impeller 4 in the subsequent stage. The return channel 30 is formed from a return bending portion 24 and the guide flow path 25.

In the return bending portion 24, the flowing direction of the working fluid G circulating outward from the inside in the radial direction through the diffuser flow path 23 is reversed inward in the radial direction. One end side (upstream side) of the return bending portion 24 communicates with the above-described diffuser flow path 23. The other end side (downstream side) of the return bending portion 24 communicates with the guide flow path 25. In an intermediate portion of the return bending portion 24, an outermost portion in the radial direction serves as a top portion. In the vicinity of the top portion, an inner wall surface of the return bending portion 24 has a three-dimensional curved surface so as not to hinder the flow of the working fluid G.

The guide flow path 25 extends inward in the radial direction from an end portion on the downstream side of the return bending portion 24. An outer end portion in the radial direction of the guide flow path 25 communicates with the above-described return bending portion 24. An inner end portion in the radial direction of the guide flow path 25 communicates with the suction flow path 21 in the flow path 2 in the rear stage as described above. Out of wall surfaces forming the guide flow path 25 in the casing 3, a wall surface on one side in the direction of the axis line O serves as a hub side wall surface 3*a*. Out of wall surfaces forming the guide flow path 25 in the casing 3, a wall surface on the other side in the direction of the axis line O serves as a shroud side wall surface 3*b*.

Next, the return vane 50 will be described with reference to FIGS. 3 and 4. A plurality of the return vanes 50 are disposed in the guide flow path 25 in the return channel 30. The plurality of return vanes 50 are radially arrayed around the axis line O in the guide flow path 25. The return vanes 50 are arrayed at an interval in the circumferential direction around the axis line O. In the return vane 50, both ends in the direction of the axis line O are in contact with the casing 3 forming the guide flow path 25. That is, one side (hub side) in the direction of the axis line O of the return vane 50 is in contact with the hub side wall surface 3*a* over the entire region in the radial direction. The other side (shroud side) in the direction of the axis line O of the return vane 50 is in contact with the shroud side wall surface 3*b* over the entire region in the radial direction.

The return vane 50 has a wing shape in which an outer end portion in the radial direction serves as a leading edge 51 and an inner end portion in the radial direction serves as a trailing edge 52 when viewed in the direction of the axis line O. The return vane 50 extends forward in a rotation direction R of the rotating shaft 1 as the return vane 50 faces from the leading edge 51 toward the trailing edge 52. The return vane 50 is curved so as to project forward in the rotation direction R. A surface facing forward in the rotation direction R in the return vane 50 serves as a suction surface 53, and a surface facing rearward in the rotation direction R serves as a pressure surface 54.

Figure 3:
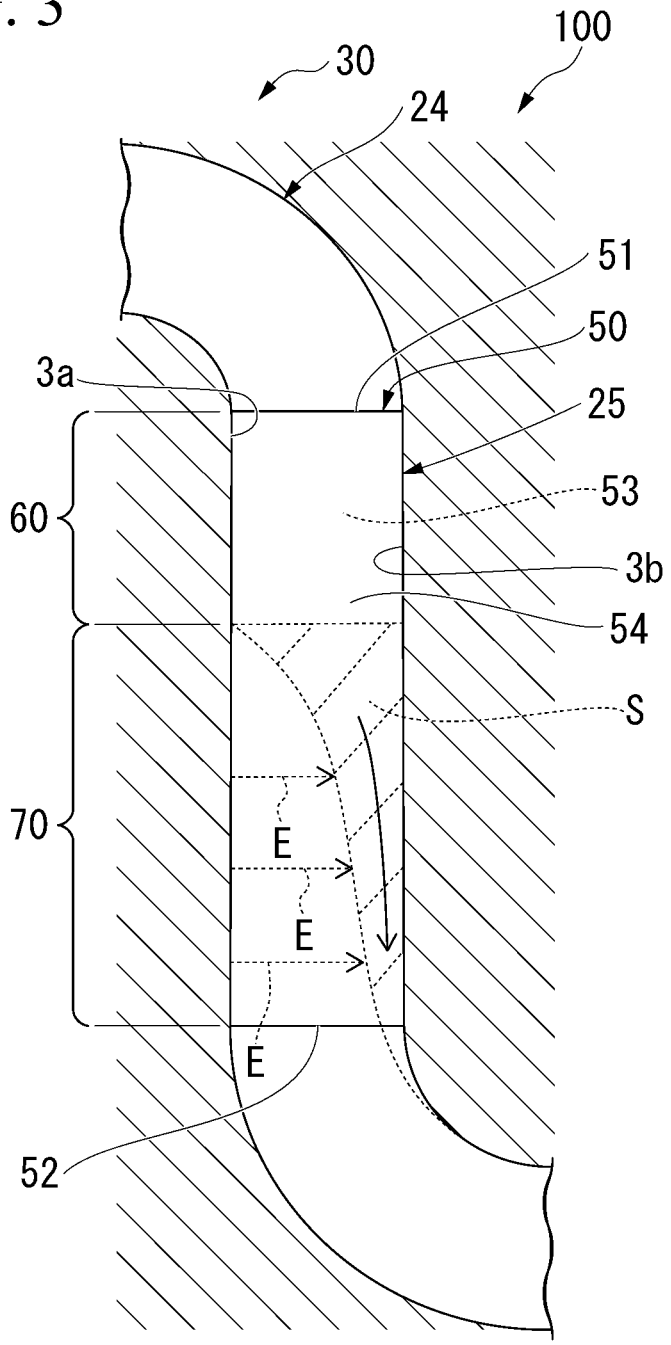
FIG. 3 is a schematic longitudinal sectional view showing a partially enlarged portion of the centrifugal compressor according to the embodiment.

As shown in FIG. 3, the return vane 50 is divided into two regions in the radial direction, such as a leading edge side region 60 including the leading edge 51, and a trailing edge side region 70 connected to the inside of the leading edge side region 60 in the radial direction and including the trailing edge 52. The leading edge side region 60 is a region of 10 to 30% of the radial dimension of the return vane 50 from the leading edge 51 to the trailing edge 52, and the trailing edge side region 70 is the remaining region from trailing edge 52 toward the leading edge 51. A boundary between the leading edge side region 60 and the trailing edge side region 70 is parallel to the axis line O.

Figure 4:
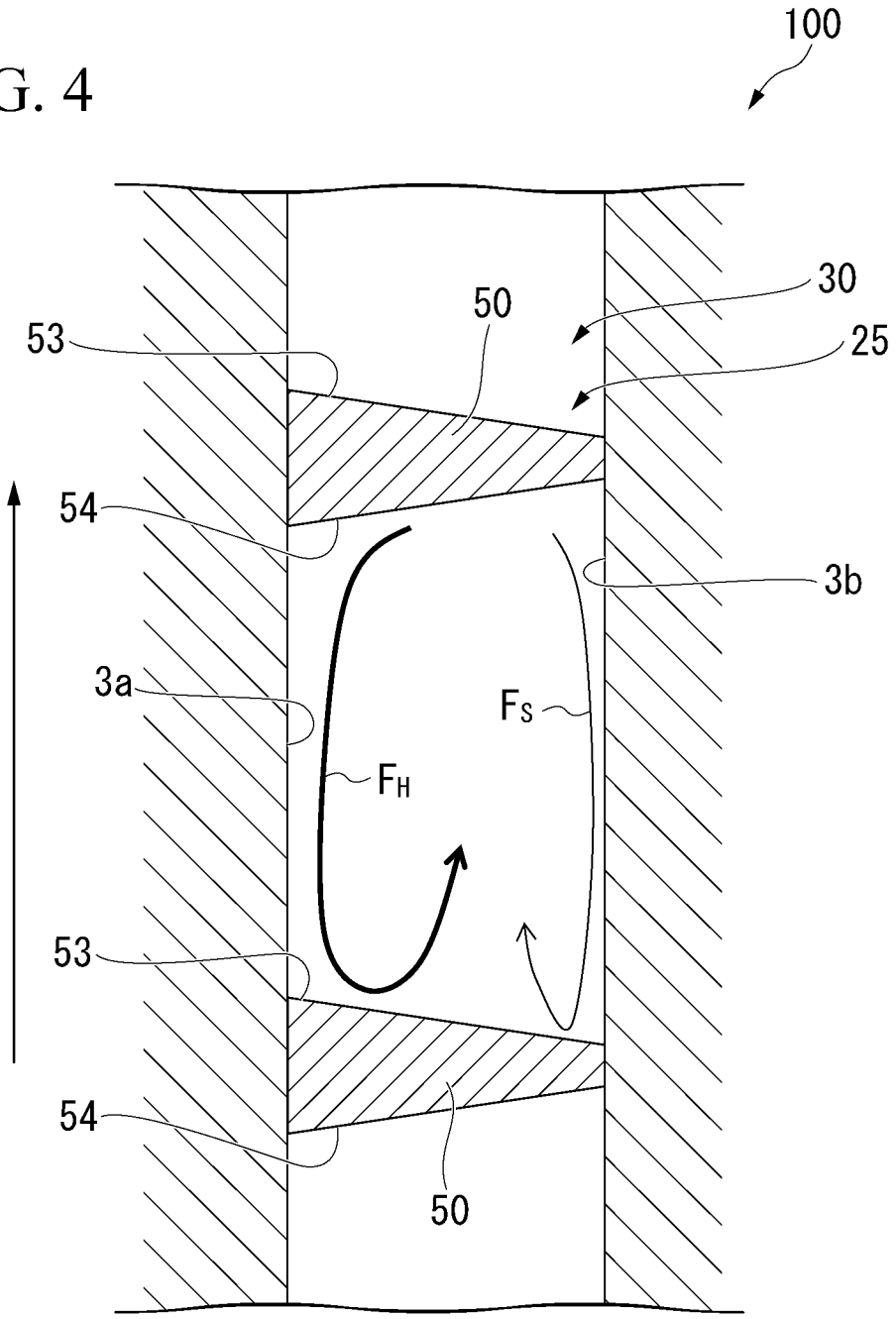
FIG. 4 is a schematic sectional view orthogonal to a radial direction of a return vane of the centrifugal compressor according to the embodiment.
Figure 5:
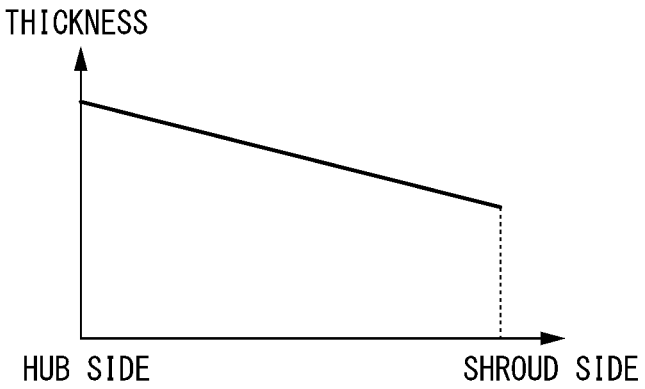
FIG. 5 is a graph showing each thickness on a hub side and a shroud side of the return vane of the centrifugal compressor according to the embodiment.

Here, as shown in FIG. 4, with regard to the thickness at each radial position of the leading edge side region 60 of each return vane 50, that is, the dimension in the circumferential direction, an end portion on the hub side of the return vane 50 is larger than an end portion on the shroud side. In the present embodiment, the thickness in the leading edge side region 60 of the return vane 50 monotonically decreases from the hub side toward the shroud side as shown in FIG. 5. In the present embodiment, the thickness in the leading edge side region 60 of the return vane 50 linearly decreases with constant inclination from the hub side toward the shroud side.

In this way, the thicknesses in the return vane 50 are different from each other on the hub side and the shroud side only in the leading edge side region 60 in the return vane 50. The thickness is constant from the hub side to the shroud side in the trailing edge side region 70. The leading edge side region 60 and the trailing edge side region 70 are smoothly and continuously connected to the pressure surface 54 and the suction surface 53. Accordingly, there is no thickness difference between the hub side and the shroud side, in a boundary the leading edge side region 60 and the trailing edge side region 70.

The return vane 50 has a wing shape from the leading edge 51 to the trailing edge 52. Accordingly, the leading edge 51 of the return vane 50 has a curved shape projecting outward in the radial direction in a sectional view orthogonal to the axis line O. The pressure surface 54 and the suction surface 53 are formed to be continuous with the curved shape. The thickness in the leading edge side region 60 of the return vane 50 is defined as a dimension of a portion excluding the curved shape in the leading edge 51, that is, a dimension between the pressure surface 54 and the suction surface 53. The thickness of the return vane 50 in the trailing edge side region 70 is similarly defined as the dimension between the pressure surface 54 and the suction surface 53.

Subsequently, an operation of the centrifugal compressor 100 according to the present embodiment will be described. The working fluid G fetched into the flow path 2 from the suction port by rotating the rotating shaft 1 and the impeller 4 flows into the compression flow path 22 in the impeller 4 after passing through the suction flow path 21 in the first stage. The impeller 4 is rotated around the axis line O by rotating the rotating shaft 1. Accordingly, a centrifugal force facing outward in the radial direction from the axis line O is added to the working fluid G in the compression flow path 22. In addition, as described above, the cross-sectional area of the compression flow path 22 gradually decreases inward from the outside in the radial direction. Accordingly, the working fluid G is gradually compressed. In this manner, the high-pressure working fluid G is fed from the compression flow path 22 to the subsequent diffuser flow path 23.

The high pressure working fluid G is pumped from the compression flow path 22. Thereafter, the working fluid G sequentially passes through the diffuser flow path 23, the return bending portion 24, and the guide flow path 25. The impeller 4 and the flow path 2 in the second and subsequent stages are similarly compressed. Finally, the working fluid G is brought into a desired pressure state, and is supplied to an external device (not shown) from the exhaust port 8.

Here, in the present embodiment, the thickness in the leading edge side region 60 of each return vane 50 is larger on the hub side than that on the shroud side. Therefore, as shown in FIG. 4, a circumferential interval between the return vanes 50 adjacent to each other in the circumferential direction is smaller on the hub side than that on the shroud side. Accordingly, the pressure gradient in the circumferential direction between the return vanes 50 is greater on the hub side having a smaller interval than that on the shroud side having a larger interval.

As a result, out of secondary flows $F_H$ and $F_S$ directed from the pressure surface 54 to the suction surface 53 of the return vanes 50 adjacent to each other, the secondary flow $F_H$ particularly on the hub side is larger than the secondary flow $F_S$ on the shroud side. In this manner, a large amount of a high energy fluid E on the pressure surface 54 of one return vane 50 is transported to the hub side on the suction surface 53 of the other return vane 50 adjacent to the one return vane 50.

In general, as shown in FIG. 3, the separation region S on the suction surface 53 of the return vane 50 has the following tendency. Due to influence that a suction flow path of the impeller of the subsequent stage (rear stage side) on an outlet side of the return vane is curved to the other side in the direction of the axis line O, the separation region S moves close to the shroud side inside the return vane 50, as the separation region S is directed inward in the radial direction. The separation region S hinders the mainstream flow. Accordingly, efficiency of the centrifugal compressor 100 is degraded. Therefore, it is preferable to minimize an area occupied by the separation region S as much as possible on the suction surface 53 of the return vane 50.

In the present embodiment, as described above, the high energy fluid E on the hub side on the pressure surface 54 of one return vane 50 is supplied to the hub side on the suction surface 53 of the other return vane 50 adjacent to the on return vane 50. Therefore, as shown in FIG. 3, the high energy fluid E pushes the separation region S to the shroud side, on the suction surface 53 of the return vane 50. Therefore, the separation region originally moved close to the shroud side can be further moved closer to the shroud side. As a result, it is possible to reduce the occupied area of the separation region S on the suction surface 53 of the return vane 50. In this manner, the centrifugal compressor 100 can be prevented from having degraded efficiency.

The high energy fluid E supplied to the suction surface 53 from the pressure surface 54 of the return vane 50 less interferes with the separated fluid on the suction surface 53. Therefore, there is no great energy loss of the high energy fluid E.

In addition, particularly in the present embodiment, the thickness in the leading edge side region 60 of the return vane 50 monotonically decreases from the hub side toward the shroud side. Therefore, the pressure gradient between the return vanes 50 adjacent to each other gradually increases toward the hub side. Therefore, the high energy fluid E on the hub side on the pressure surface 54 can be properly transported to the hub side on the suction surface 53.

Here, the pressure difference between the pressure surface 54 and the suction surface 53 of the return vane 50 is most remarkable on the leading edge 51 side where the fluid flow is diverted. The pressure difference is smaller on the trailing edge 52 side. Therefore, a region where the thickness on the hub side of the return vane 50 is thicker than the thickness on the shroud side is set only within the above-described range on the leading edge 51 side. In this manner, an advantageous effect can be sufficiently achieved. Furthermore, in a case where a thickness gradient on the hub side and the shroud side of the return vane 50 is formed by carrying out cutting work, the work may be carried out only within the above-described range. Accordingly, an increase in manufacturing cost can be prevented.

In the present embodiment, the thickness on the hub side only in the leading edge side region 60 which is 10% to 30% of the region from the leading edge 51 toward the trailing edge 52 in the radial dimension of the return vane 50 is thicker than the thickness on the shroud side. Therefore, while the separation region S is reduced on the suction surface 53 of the return vane 50, the increase in the manufacturing cost can be prevented.

If the thickness on the hub side of the return vane 50 is simply increased compared to the thickness in the related art, a throat area serving as the flow path between the return vanes 50 is reduced. In order to avoid this disadvantage, the thickness on the shroud side may be decreased as much as the thickened amount on the hub side. In this manner, the throat area can be properly secured.

Hitherto, the embodiment according to the present invention has been described. However, without being limited thereto, the present invention can be appropriately modified within the scope not departing from the technical idea of the invention.

In the embodiment, in the leading edge side region 60 of the return vane 50, the thickness decreases with the constant inclination from the hub side toward the shroud side. However, the present invention is not limited thereto. The thickness may monotonically decrease from the hub side toward the shroud side.

In the embodiment, a configuration has been described in which the return vane 50 is formed only inside the guide flow path of the return channel 30. However, the leading edge 51 of the return vane 50 may be located inside the return bending portion 24. The leading edge 51 of the return vane 50 may be located not only in the boundary between the return bending portion 24 and the guide flow path, but also inside or outside the boundary in the radial direction.

In the embodiment, the thickness on the hub side of the return vane 50 is thicker than the thickness on the shroud side only in the leading edge side region 60. However, the thickness on the hub side may be thicker than the thickness on the shroud side in the entire region in the radial direction of the return vane 50.

Hitherto, the embodiments according to the present invention have been described. However, the present invention is not limited to the specific embodiments, and can be changed and modified in various ways within the concept scope of the present invention disclosed in the appended claims.

INDUSTRIAL APPLICABILITY

The present invention is applicable to the centrifugal compressor.

REFERENCE SIGNS LIST

1: rotating shaft
2: flow path
3: casing
3*a*: hub side wall surface

3*b*: shroud side wall surface
4: impeller
5: journal bearing
6: thrust bearing
7: suction port
8: exhaust port
21: suction flow path
22: compression flow path
23: diffuser flow path
24: return bending portion
25: guide flow path
30: return channel
41: disk
42: blade
43: cover
50: return vane
51: leading edge
52: trailing edge
53: suction surface
54: pressure surface
60: leading edge side region
70: trailing edge side region
100: centrifugal compressor
O: axis line
R: rotation direction
G: working fluid
$F_H$: secondary flow
$F_S$: secondary flow
S: separation region
E: high energy fluid

What is claimed is:

1. A centrifugal compressor comprising:

a rotating shaft that is rotatable about an axis line;

impellers arranged in a plurality of stages along the rotating shaft in an axial direction so that a working fluid flowing from one side inlet in the axial direction is pumped outward in a radial direction;

a casing that surrounds the rotating shaft and the impellers, and that has at least one return channel through which the working fluid discharged from the impeller on a front stage side between the impellers adjacent to each other is guided inward in the radial direction so as to be introduced to the impeller on a rear stage side; and a plurality of return vanes disposed inside the at least one return channel at intervals in a circumferential direction, wherein each return vane of the plurality of return vanes is configured so that a thickness of a hub side on one side in the axial direction in a region including a leading edge is thicker than a thickness of a shroud side on another side in the axial direction.

2. The centrifugal compressor according to claim 1, wherein the thickness of the return vane monotonically decreases from the hub side toward the shroud side, in the region including the leading edge.

3. The centrifugal compressor according to claim 1, wherein the region including the leading edge is 10% to 30% of a region from the leading edge toward a trailing edge in a radial dimension of the return vane.

4. The centrifugal compressor according to claim 1, wherein the thickness is constant in a trailing edge side region of the return vane.

5. The centrifugal compressor according to claim 1, wherein a leading edge side region of the return vane and a trailing edge side region of the return vane are smoothly and continuously connected to each other.

6. The centrifugal compressor according to claim 1, wherein there is no thickness difference between the hub side and the shroud side, in a boundary between a leading edge side region of the return vane and a trailing edge side region of the return vane.

7. The centrifugal compressor according to claim 1, wherein the thickness linearly decreases with constant inclination in a leading edge side region of the return vane.

* * * * *